United States Patent [19]

Groos et al.

[11] Patent Number: 4,750,345

[45] Date of Patent: Jun. 14, 1988

[54] RECYCLING PRESSURE PLATES AND DIES IN EXTRUSION PRESSES

[75] Inventors: Horst Groos, Mettmann; Siegfried Blasche, Dusseldorf, both of Fed. Rep. of Germany

[73] Assignee: SMS Hasenclever Maschinenfabrik GmbH, Dusseldorf, Fed. Rep. of Germany

[21] Appl. No.: 43,477

[22] Filed: Apr. 28, 1987

[30] Foreign Application Priority Data

Apr. 29, 1986 [DE] Fed. Rep. of Germany ..... 3614478

[51] Int. Cl.[4] ..... B21C 35/04

[52] U.S. Cl. ..... 72/255; 72/263; 72/273.5

[58] Field of Search ..... 72/255, 263, 273.5

[56] References Cited

U.S. PATENT DOCUMENTS

| | | | |
|---|---|---|---|
| 3,530,702 | 9/1970 | De Ridder | 72/255 |
| 4,103,529 | 8/1978 | Huertgen et al. | 72/263 |
| 4,154,081 | 5/1979 | Boshold | 72/263 |
| 4,230,661 | 10/1980 | Asari et al. . | |
| 4,365,497 | 12/1982 | Asari et al. . | |
| 4,424,696 | 1/1984 | Asari et al. . | |

FOREIGN PATENT DOCUMENTS

| | | |
|---|---|---|
| 603139 | 9/1934 | Fed. Rep. of Germany . |
| 1602280 | 5/1970 | Fed. Rep. of Germany . |

*Primary Examiner*—Lowell A. Larson

*Attorney, Agent, or Firm*—Holman & Stern

[57] ABSTRACT

For recycling the dies and pressure plates, in an extrusion press designed to perform both direct and indirect extrusion, a common conveyor extends beside the press between a device for stripping extrusion residue from the dies, and a device for separating extrusion residue from pressure plates. A first transfer arm is provided to transfer a pressure plate and direct extrusion residue from the press axis to the conveying means for conveyance to the pressure plate-separating device. The same transfer arm serves to transfer stripped dies from the conveying means to the press axis. A second transfer arm removes the die, pressure plate and extrusion residue after indirect extrusion, to the conveying means, which conveys the die to the die stripper, and the pressure plate and extrusion residue to the device for separating the extrusion residue from the pressure plate. Separated pressure plates are recycled to a magazine and then to the press axis for re-use.

6 Claims, 4 Drawing Sheets

RECYCLING PRESSURE PLATES AND DIES IN EXTRUSION PRESSES

BACKGROUND OF THE INVENTION

This invention relates to a conveyor system for the recycling of pressure plates and dies to extrusion presses adapted for direct and indirect extrusion If extrusion and pipe presses are designed both for direct and also for indirect extrusion (see Hydraulische Pressen, Third Volume, Pages 93 to 98 by Ernst Mueller. Springer Verlag, 1959: DE-PS No. 24 19 709; Metall, Year 37, No. 8, August 1983, Page 778), the problem arises of removing the pressure plate connected to the billet residue during direct extrusion and also of removing the die during indirect extrusion, cleaning them and recirculating them to the press, because, not only does the billet residue appear at different points with the pressure plate during direct and indirect extrusion, but the die appears in addition to the billet residue and the pressure plate during indirect extrusion. The use of two separate recycling conveyors of the type which would suggest itself owing to the differing conveying paths and differing materials to be conveyed, however, entails correspondingly high construction costs and takes excessive space.

A conveyor system for recycling dies and pressure plates in an extrusion press, incorporating means for separating the extrusion residue, is described in U.S. patent application Ser. No. 933,911 filed Nov. 24, 1986 and assigned to the assignees of the present application.

The present invention relates particularly to a conveyor system for recycling of pressure plates and dies associated with extrusion and pipe presses adapted for direct extrusion and indirect extrusion, in which the pressure plates with adhering billet residue on the one hand and, in addition in the case of indirect extrusion, the dies with adhering billet residue on the other hand pass through separating devices inserted into the conveyor system for separating the pressure plate from the billet residue on the one hand and for separating the die from the billet residue on the other hand and of which the pressure plates are discharged into the loading tray of the billet loader and, during indirect extrusion, the dies are brought back into the working position on the end face of the die ram.

An object of the present invention is to provide a recycling conveyor system, of simplified structure and more compact design.

In the invention this is achieved by a combination of operations, and corresponding design of the elements of the system.

SUMMARY OF THE INVENTION

According to one aspect of the invention, a conveyor arranged parallel to the press axis, in its end positions, connects a device for separating the pressure plate from the billet residue and a device for separating the die from the billet residue and in that transfer devices connecting the path of the conveyor and the press axis are provided, of which one is designed for the ejection of the pressure plate during direct extrusion and for the introduction of the die during indirect extrusion while the other is designed for taking up and ejecting the die and the pressure plate with billet residue in two separate pick-ups during indirect extrusion, the transfer devices being movable parallel to the press axis and to the conveyor between the pick-up and discharge positions.

In one preferred arrangement, the transfer device used both during direct extrusion (for ejecting the pressure plate with billet residue) and during indirect extrusion (for introducing the die) is provided with a gripper which is held by a lever, is pivotable therewith transversely to the press axis, can be opened and closed and grips the pressure plate and die.

Preferably, the lever holding the gripper forms the outer part of an angled lever which is pivotable about an axis positioned lower than the press frame, this lever extending between two columns of the press frame with the outer lever part when in its pivoted position orientated towards the press axis, the outer lever part being pivotable to a limited extent in the pivoting plane of the lever relative to the inner lever part at the angle point.

According to another preferred feature of the invention, the transfer device used both during direct extrusion (for ejecting the pressure plate with the billet residue) and also during indirect extrusion (for introducing the die) has, in addition to a defined end position intersecting the press axis and intersecting the path of the conveyor, a defined intermediate position outside the working region of the conveyor.

DESCRIPTION OF PREFERRED EMBODIMENTS.

Figure 1A:
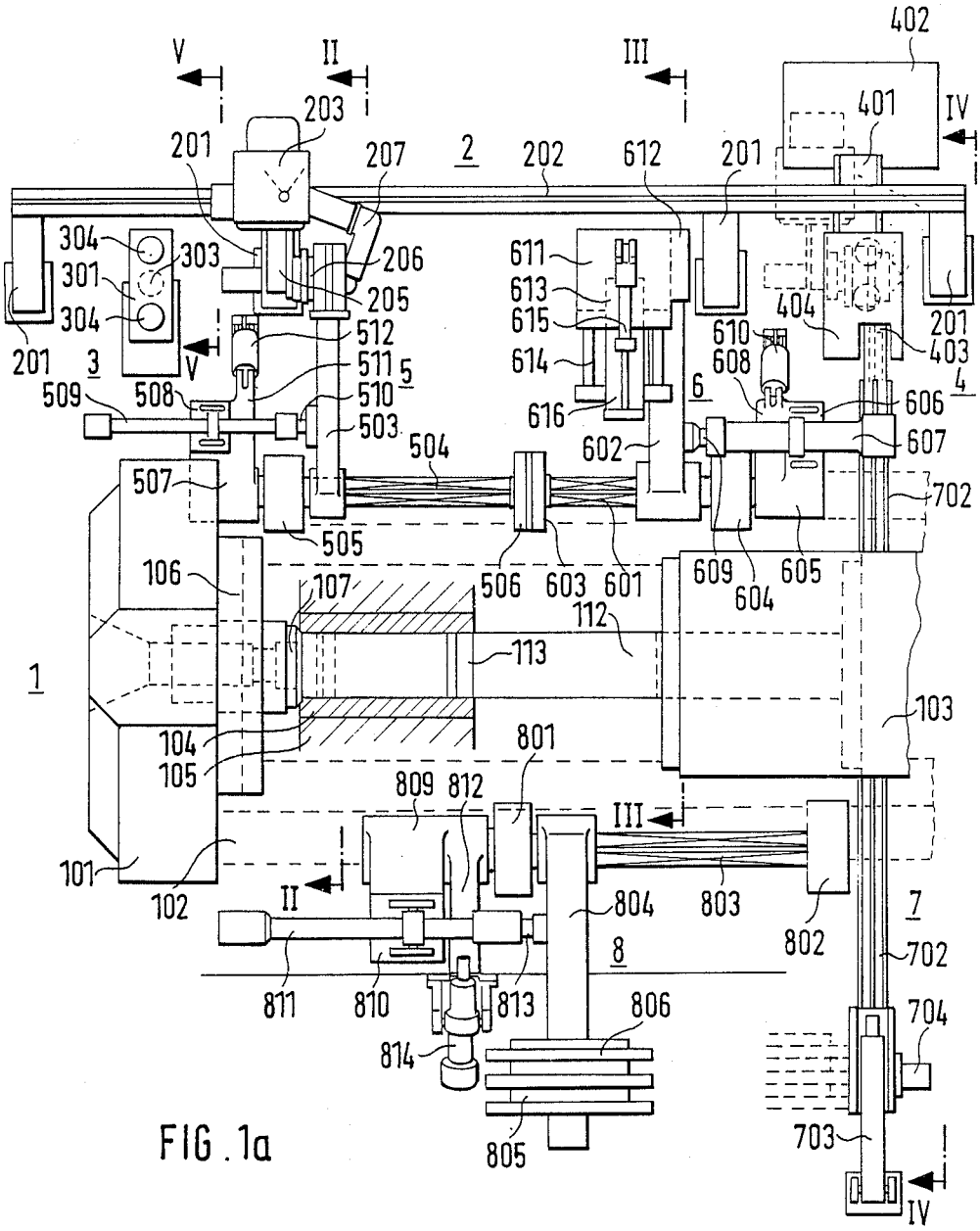
FIGS. 1*a* and 1*b* show in plan view the press with associated conveyor system for direct extrusion (FIG. 1*a*) and for indirect extrusion (FIG. 1*b*) at the beginning of the extrusion process in each case.

A press 1 of known design adapted for direct and indirect extrusion is shown only schematically in the drawings by a crosshead 101 which is connected by columns or ties 102 with a cylinder crosshead (not shown) to form a press frame. A travelling crosshead 103 in the press frame can be moved along the columns 102 by a piston (also not shown). A receiver holder 105 provided with a receiver sleeve 104 is also movable along the columns 102. The crosshead 101 of the press is provided with a tool holder (tool slide or tool turret) 106 which bears a die 107 during direct extrusion (FIG. 1*a*). The die 107 is exchanged as necessary and in known manner by the tool holder 106. The receiver holder 105 and with it the receiver sleeve 104 are kept in contact with the die 107 during direct extrusion by means of a feed device (not shown). During indirect extrusion (FIG. 1*b*), the tool holder 106 bears a hollow ram designated as die ram 108, which bears a die 109 and through which the extruded material emerges. The receiver holder 105 with the receiver sleeve 104 is moved over the die ram 108 by the feed device together with the travelling crosshead 103 during indirect extrusion. In this arrangement, the travelling crosshead 103 is provided with a sealing ram 110 which keeps the receiver sleeve 104 closed against the extrusion direction with a sealing plate 111. During direct extrusion, on the other hand, the travelling crosshead 103 is provided with an extrusion ram 112 with a frontal extrusion plate 113, and the extrusion ram 112 with the extrusion plate 113 is pressed into the opening in the receiver sleeve 104 by the travelling crosshead 103.

The press is provided with a conveyor system for recycling extrusion plates and dies. This conveyor system consists of a conveyor 2 arranged next to the press and parallel to the press axis, a separating device 4 for separating the pressure plate 113 or sealing plate 111 from the billet residue, a separating device 3 for separating the dies 109 from the billet residue formed from the compacted shell, a first transfer device 5 for removing the pressure plate 113 during direct extrusion and for introducing the dies 109 during indirect extrusion, a second transfer device 6 for removing the die 109 with sealing plate 111 and billet residue during indirect extrusion, a magazine 7 for sealing plates 111 or pressure plates 113 as well as a billet loader 8.

The conveyor 2 consists of a girder or rail 202 which is borne by gallows shaped supports 201 and on which a carriage 203 can travel. The carriage 203 is provided with wheels for this purpose and is guided on the girder 202. A geared motor 204 drives a pinion which meshes into a rack travelling along the girder 202 and fixed thereon and thus moves the carriage 203. The carriage 203 is provided with an extension arm 205 bearing a pressure plate 206 which is mounted in slightly resilient manner and is rotatable by 45° or more. The carriage 203 also bears an angular or bell crank lever 207 which is provided at its free end with pressure rollers and can be pivoted about a vertical shaft towards the pressure plate 206. The pressure plate 206 and the angular lever 207 are for gripping dies 109 and sealing plates 111 with billet residue, which are then conveyed by the carriage 203.

The separating device 3 consists of a C-shaped frame 301 which is open laterally toward the conveyor 2 and has a saddle 302 on which a die 109 brought by the conveyor 2 can be deposited. A hydraulically actuated clamping jaw 303 clamps the die 109 between itself and the saddle 302. Using hydraulically actuated rams 304 equipped with blades, the die 109 is freed, on two diametral peripheral parts, of billet residue, which appears as compressed shell in chambers at the periphery of the die. The die 109 can be rotated by 90° if necessary and the shearing process can be repeated or continued in a second stroke of the ram 304. Rotation of the die 109 is effected by a special rotating device or by rotation of the pressure plate 206, for which purpose the die 109 should again be clamped between the pressure plate 206 and the angular lever 207 on the carriage 203. The die 109 is then brought by the conveyor 2 into a position in which it can be taken over by the transfer device 5 for re-use.

The separating device 4 is similar in structure to the separating device 3, but the separating device 4 is provided only with a blade which is movable along one end face of the sealing plate 111 or the pressure plate 113, the blade shearing off the billet residue from the sealing plate 111 or pressure plate 113. The sheared-off billet residue passes via a chute 401 into a scrap bin 402. The sealing plate 111 or the pressure plate 113 is ejected laterally from an opening 403 in the C-shaped frame 404 after the clamping jaw has been released and is lowered by a supporting device 701 into a grove 702 in the magazine 7.

Figure 2:
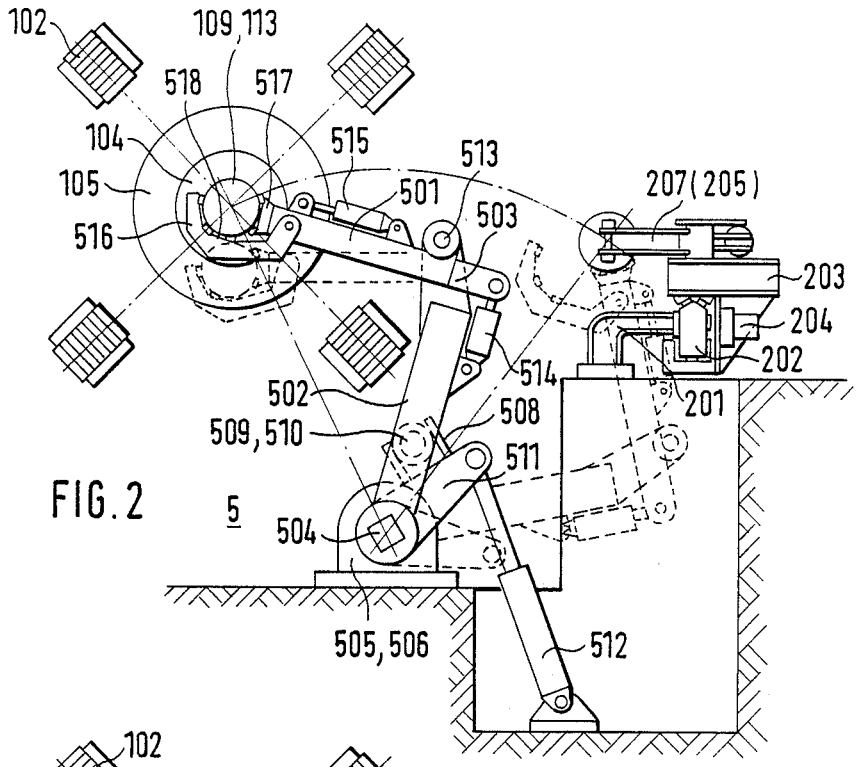
FIG. 2 shows the transfer devices pertaining to the conveyor system in side view in section along line II—II.

The transfer device 5 has an angular lever 503 which is composed of an outer lever part 501 and an inner lever part 502. The inner lever part 502, provided with a rectangular hole, rests in rotationally engaged manner but longitudinally movably on a square shaft 504. The square shaft 504 is mounted rotatably in the bearings 505 and 506. At the shaft end passing through the bearing 505, the square shaft 504 is rigidly connected to a boss 507 which, on the one hand, is designed as a bracket 508 for a cylinder 509 and, on the other hand, is provided with a lever arm 511. A piston 510 in the cylinder 509 acts on the inner lever part 502 and pushes the angular lever 503 along the square of the shaft 504. The lever arm 511 is acted on by a piston-cylinder unit 512 supported on the floor, by which the square shaft 504 can be pivoted with the angular lever 503 in the bearings 505 and 506. As shown in FIG. 2, the outer lever part 501 is connected to the inner lever part 502 by a hinge pin 513 and can be pivoted about the hinge pin by means of a piston-cylinder unit 514 acting between the lever parts 501 and 502. The outer lever part 501 is provided at its free end with a gripper arm 516 which can be pivoted by a piston-cylinder unit 515, and forms with the head piece 517 of the outer lever part 501 a gripper 518 with which a die 109 or a pressure plate 113 with a billet residue can be gripped and conveyed. If the billet residue remaining in front of the die 107 together with the pressure plate 113 is to be separated from the extruded material in the die 107 on termination of direct extrusion, the receiver holder 105 with the receiver sleeve 104 is moved sufficiently far from the die 107 for the billet residue with the pressure plate 113 to be cleared and to be separated from the extruded material by a blade (not shown) which is moved downwards along the end face of the die 107, the billet residue and the pressure plate 113 being pressed downwards. To allow this, the lever part 501 is pivotally connected to the lever part 502 in the manner described.

The transfer device 6 is formed by an angular lever 602 which is provided with a rectangular hole and which rests in a rotationally engaged but longitudinally movable manner on a square shaft 601, the square shaft 601 being mounted in bearings 603 and 604. A shaft end projecting from the bearing 604 is rigidly connected to a boss 605 and this boss 605 is designed as a bracket 606 for a cylinder 607 and is also provided with a lever arm 608. A piston 609 in the cylinder 607 acts on the angular leyer 602 and pushes it along the square shaft 601. The angular lever 602 can be pivoted via the square shaft 601 by a piston-cylinder unit 610 which is supported on the floor and acts on the lever arm 608. The angular lever 602 bears a U-shaped head piece 611 whose U-opening allows room, depending on its length, for a die 109, a sealing plate 111, a billet residue placed between them and the angular lever 207 to the carriage 203 of the conveyor 2. At the end facing the sealing ram 110 of the press 1, the U-opening o the head piece 611 is covered by a bridge piece 612 so that the receiver holder 105 with the receiver sleeve 104 can be shifted via the head piece 611 by the travelling crosshead 103 with the sealing ram 110 of the press 1 so that the die 109 with the billet residue and the sealing plate 111 can be ejected from the receiver sleeve 104 on termination of the indirect extrusion process, if the force of the feed device for the receiver holder 105 is not sufficient for this purpose.

The head piece is provided with an aperture 613 in the centre where the billet residue lies with the sealing plate 111. A support 616 for the billet residue with the sealing plate 111 can be shifted on guide rods 614 by means of a piston-cylinder unit 615. As the billet residue with sealing plate 111 is being sheared off the die 109, the die 109 rests on the base of the U-opening of the head piece 611 rests on a bracket (not shown) on the receiver holder 105 and shearing off is effected by a shearing device (not shown), which is fixed on the receiver holder and acts of the billet residue with sealing disc 111. As the billet residue and sealing plate 111 are being sheared off, they are pushed into the aperture 613 in the head piece 611 where they are held by the support 616.

The sealing plates 111 or pressure plates 113 issuing from the separating device 4, taken over by the supporting device 701 and collected in the groove 702, are stored in the magazine 7. The sealing plate 111 or pressure plate 113 lying foremost in each case is brought by means of a pivot arm 703 into the loading position equiaxially to that of the billet loader 8. An ejector 704 is provided for transferring the sealing plate 111 or the pressure plate 113 onto the block loader 8 at a given moment.

The billet loader 8 consists of a square shaft 803 mounted in the bearings 801 and 802, an angular lever 804 which is provided with a square hole and rests in a rotationally engaged but longitudinally movable manner on the square shaft 803 and a loading tray 805 at the end of the angular lever 804. The loading tray 805 is completed by a sector 806 which can be pivoted by means of a piston-cylinder unit 807 and lever 808 and thus opens or closes the loading tray 805. A boss 809 is connected to a shaft portion of the square shaft 803 penetrating the bearing 801, forms the bracket 810 for fixing a cylinder 811 and is provided with a lever arm 812. The angular lever 804 can be adjusted along the square shaft 803 by a piston 813 in the cylinder 811 which acts on the angular lever 804, while a piston-cylinder unit 814 is capable of pivoting the square shaft 803 and therefore the angular lever 804 with the loading tray 805 by means of the lever arm 812.

Figure 1B:
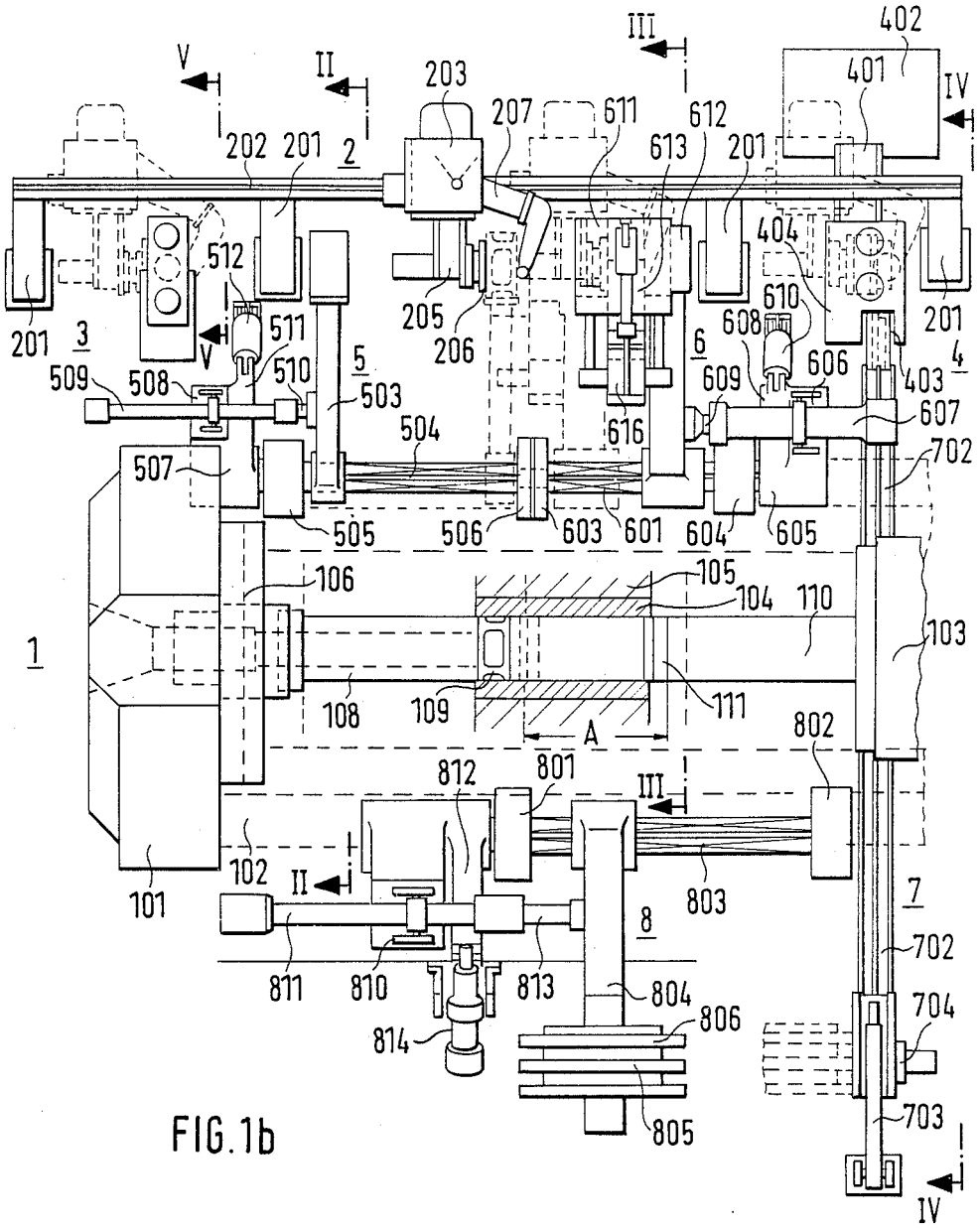
Figure 3:
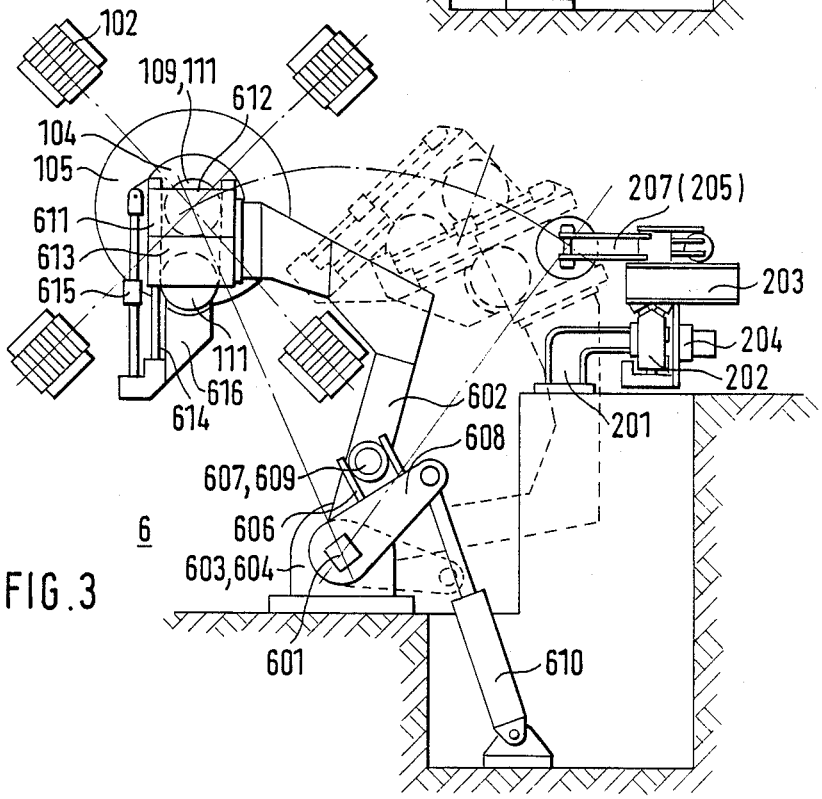
FIG. 3 shows the transfer devices pertaining to the conveyor system in side view in section along the line III—III.
Figure 5:
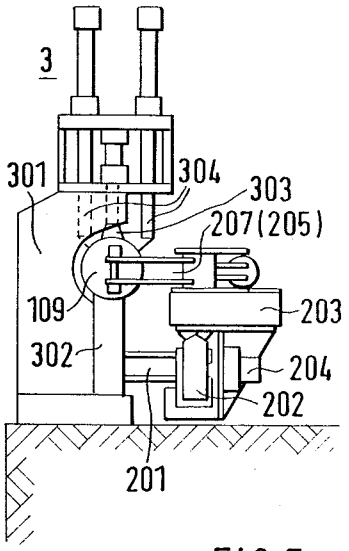
FIG. 5 shows the device for separating the die from the press billet residue butt in side view in section along the line V—V.
Figure 4:
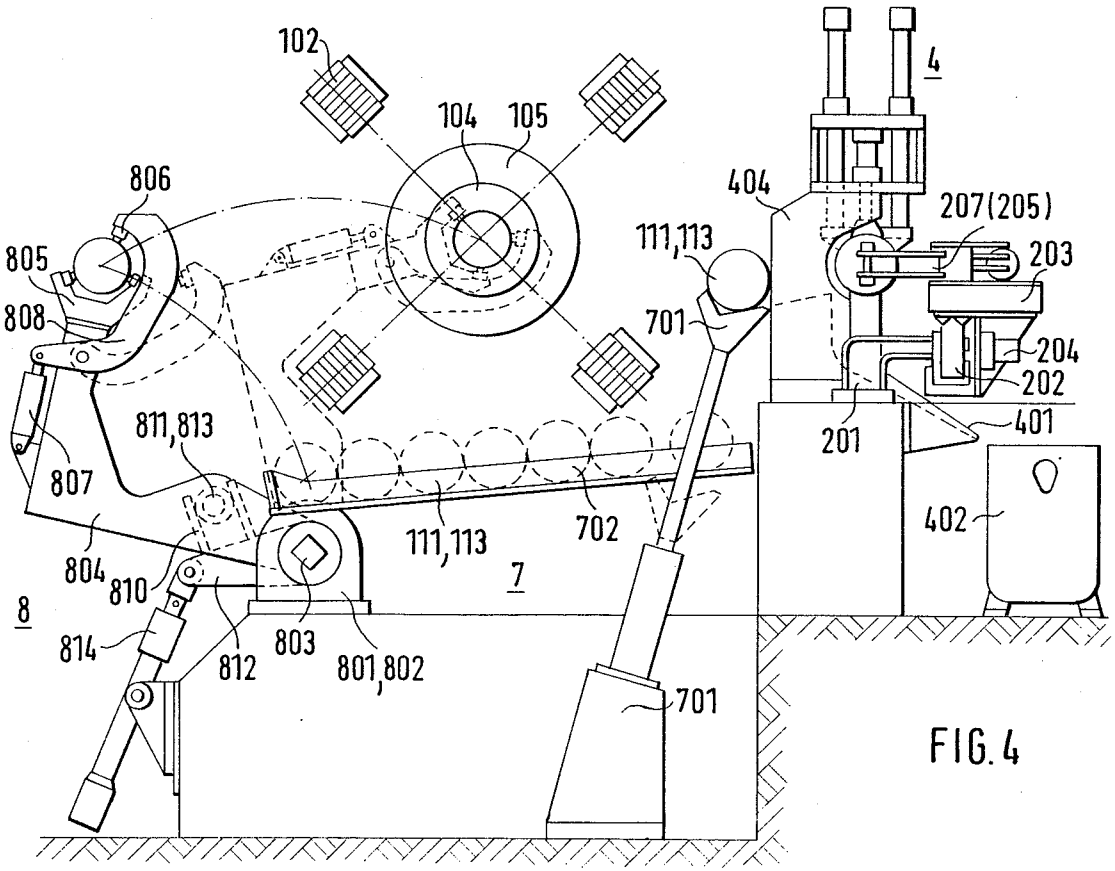
FIG. 4 shows the billet loading device in side view in section along the line IV—IV.

Operation is as follows:

FIG. 1*a* shows the press 1 at the beginning of direct extrusion, which takes place as a result of the advance of the ram 112 in that the billet held by the receiving sleeve 104 is extruded through the die 107 to form a strand right up to a billet residue which is located between the pressure plate 113 and the die 107 at the end of the extrusion process (see broken line representation of pressure plate 113 with billet residue). The receiver holder 105 with the receiver sleeve 104 is then moved back until the pressure plate 113 with the billet residue are clear. The transfer device 5 is then brought into the position shown in FIG. 2. The billet residue with the pressure plate 113 is then separated from the strand of extruded material along the end face of the die by means of the shears (not shown), and the strand is extracted from the die 107. When shearing the billet residue with the pressure plate 113 from the strand, the billet residue and pressure plate 113 are pressed down by the shears while the outer lever 501 of the transfer device 5 pivots round the hinge pin 513 into position shown in broken lines in the left-hand part of FIG. 2. From here, the transfer device 5 then pivots into position shown in the right-hand part of FIG. 2 in which it is located in the line of the conveyor 2 where the carriage 203 of the conveyor 2 is located when the gripper is open (pressure plate 206, open angular lever 207). As soon as this position is reached, the angular lever 207 is closed and the pressure plate 113 with the billet residue is gripped by the pressure plate 206 and the angular lever 207, the gripping arm 516 is then pivoted out and the gripper 518 is opened. The carriage 203 then travels along the girder 202 and brings the pressure plate 113 with billet residue into the separating device 4. There, the pressure plate 113 is clamped against the saddle by the clamping jaw, the billet residue is then sheared off the pressure plate 113, the clamping jaw is subsequently released and the pressure plate 113 ejected. As the billet residue enters the scrap bucket 402, the pressure plate 113 is taken over by the support device 701 and lowered into the groove 702 of the magazine 7. The procedure is completed as the carriage 203 returns into the starting position shown in FIG. 1*a*. For the next extrusion process, the billet loader 8 is brought into the position shown in broken lines in FIG. 1*a* and is there provided with a pressure plate 113 which is raised from the groove 702 in the magazine 7 by the lever 703 to the level of the billet loading tray 805 and is ejected in the billet loading tray 805 by the ejector 704. The billet loading tray 805 is also provided with the fresh billet. Once the travelling crosshead 103 has travelled sufficiently far back with the extrusion ram 112 (position shown in broken lines), the billet loading tray 805 is pivoted from the starting position shown in FIGS. 1*a* and 4 into the press 1 so that the loading tray 805 is coaxial with the main axis of the press 1 (position shown in broken lines in FIG. 4). The billet and the pressure plate 113 are pushed into the receiver sleeve 104 until the starting position shown in FIG. 1*a* is reached, by advancing the travelling crosshead 103 with the extrusion ram 112 again. Once the billet loader 8 has been pivoted back into the starting position shown in FIG. 1*a*, the next extrusion process can begin. The starting position for indirect extrusion is shown in FIG. 1*b*. The travelling crosshead 103 with the sealing ram 110 and sealing plate 111 and the receiver holder 105 with the receiver sleeve 104 which are arranged uniformly and in the same direction as them are moved towards the crosshead 101 while the receiver sleeve 104 is pushed over the die ram 108 and the billet enclosed in the receiver sleeve 104 is pressed through the die 109 supported by the hollow die ram 108 to form the strand issuing through the opening in the die ram 108. A billet residue with the sealing plate 111 remains in front of the die 109. Once the travelling crosshead 103 with the sealing ram 110 has travelled back into the starting position, there is a distance A between the sealing ram 110 and the receiver sleeve 104, into which the transfer device 6 is pivoted and then assumes the position shown in FIG. 3. The travelling crosshead 103 now presses with the sealing ram 110 onto the bridge piece 612 of the head piece 611 of the transfer device 6. The receiver holder 105 with the receiver sleeve 104 is shifted beyond the head piece 611 sufficiently far for the front end of the die ram 108 to lie flush with the end face of the receiver sleeve 104 facing the head piece 611 of the transfer device 6, while the die 108, the billet residue and the sealing plate 111 are taken up by the head piece 611 in its U-opening. Shears fixed on the receiver holder now separate the billet residue and the sealing plate 111 adhering to it from the die 108 so that the strand is also cleared and can be extracted from the die. As the billet residue with the sealing plate 111 is sheared from the die 108, the head piece 611 rests on a bracket on the receiver holder 105 while the die 108 rests in the head piece 611. The billet residue with the sealing plate 111, are diverted into the perforation 613 and are collected by the support 616. Once the shearing blade has travelled out again, the transfer device pivots into the extreme right-hand position which is shown in broken lines in FIG. 3 and where the carriage 203 of the conveyor 2 is ready to take up and grip the die between the pressure plate 206 and the angular lever 207. The carriage 203 then travels to the left with the die 108 and deposits the die 109 in the separating device 3. At the same time, the transfer device 6 travels outwards to the right into the parking position shown in FIG. 1*b*. The die 109 is clamped by the clamping jaw 303 and the saddle 302 in the separating device 3 and is freed from billet residue by rams 304 equipped with blades. The die 109 is then gripped between pressure plate 206 and angular lever 207 of the carriage 203 again and brought into the position in which the die 109 is taken over by the transfer device 5 and can be introduced onto the press axis for re-use. This is the right-hand position of the transfer device 5 which is shown in broken lines in FIG. 1*b* and in which the transfer device 5 takes the die 109 from the carriage 203 of the conveyor, whereupon the transfer device 5 pivots into the left-hand position shown in FIG. 2 in which it holds the die 109 in readiness for the next pressing process. The carriage 203 then travels further to the right in order to remove the billet residue with the adhering sealing plate 111 from the transfer device 6 still located in the parking position. Once the carriage 203 has travelled sufficiently far to the left for the transfer device to be able to pivot into the semi-upright intermediate position shown in broken lines in FIG. 3, the carriage 203 travels completely to the right and passes the billet residue with the sealing plate 111 into the separating device 4 where the sealing plate 111 is separated from the billet residue just like the pressure plate 113 during direct extrusion and deposited in the magazine 7. The carriage 203 then returns into its starting position and the transfer device 6 returns into the parking position. The next extrusion process is initiated in that the transfer device 5, whose gripper 518 is provided with the die 109 and is pivoted into the position shown in FIG. 2 in which the die 109 lies in the press axis in front of the die ram 108. The travelling crosshead 103 with the sealing ram 110 is driven back sufficiently far for the loading tray 805 of the billet loader 8, which has previously been provided with a billet and with a sealing plate 111 from the magazine 7 by means of the lever 703 and the ejector 704, to be able to pivot from the position shown in FIG. 1*b* and 4 into the position shown in broken lines in FIG. 4 so that the die 109 of the billet to be extruded and the sealing plate 111 lie in succession on the press axis. The travelling crosshead 103 and the sealing ram 110 are advanced with moderate force and the die 109, the billet and the sealing plate 111 are clamped easily between the die ram 108 and the sealing ram 110 so that the gripping arm 516 and then the transfer device 5 can be pivoted out together. Since the receiver holder 105 with the receiver sleeve 104 is initially pushed over the die 109 and then over the billet and the sealing plate 111, the billet loader 8 turns axially with the loading tray 805. Once the receiver holder 105 with the receiver sleeve 104 has entered the starting position shown in FIG. 1*b*, the sector 806 of the loading tray 805, in the first instance, and then the entire billet loader 8 are pivoted out and the extrusion process begins.

We claim:

1. A conveyor system for the recycling of pressure plates and dies associated with extrusion and pipe presses adapted for direct extrusion and indirect extrusion, in which the pressure plates with adhering billet residue on the one hand and, in addition in the case of indirect extrusion, the dies with adhereing billet residue on the other hand pass through separating devices inserted into the conveyor system for separating the pressure plate from the billet residue on the one hand and separating the die from the billet residue on the other hand and of which the pressure plates are discharged into the loading tray of the billet loader, during indirect extrusion, the dies are brought back into the working position on the end face of the die ram, characterised in that a conveyor arranged parallel to the press axis, in its end positions, connects a device for separating the pressure plates from the billet residue and a device for separating the die from the billet residue and in that transfer devices connecting the path of the conveyor and the press axis are provided, of which one is designed for the removal of the pressure plate during direct extrusion and for the introduction of the die during indirect extrusion while the other is designed for taking up and removing the die and the pressure plate with billet residue in two separate pick-ups during indirect extrusion, the transfer devices being movable parallel to the press axis and to the conveyor between the pick-up and discharge positions.

2. In an extrusion press of the kind adapted to perform extrusion of a metal billet selectively by direct extrusion and by indirect extrusion, comprising an extrusion die, a pressure plate, and a billet receiver disposed in operation there between on a press axis, and means for applying pressure through the pressure plate to a billet in the said receiver for extruding the metal of the said billet through the said die, whereby in direct extrusion an extrusion residue remains attached to the pressure plate, and in indirect extrusion an extrusion residue remains attached to the pressure plate and to the die, means for recycling the said pressure plates and dies, comprising:

conveying means having a conveying path generally parallel to the press axis and having longitudinally spaced end positions;

at one said end position, a first separating means adapted to separate a pressure plate from an extrusion residue;

at the other said end position, a second separating means adapted to separate a die from an extrusion residue;

first lateral transfer means having a transfer path extending transversely between and interconnecting the conveying path and the press axis ajacent the said first separating means, the said first lateral transfer means being arranged and adapted to transfer a pressure plate, extrusion residue and die from the press axis to the conveying means after indirect extrusion;

means for moving the first lateral transfer means in the longitudinal direction of the press axis and of the conveying path, the said first lateral transfer means having respective positions for receiving the die, indirect extrusion residue and pressure plate on the press axis, for transferring the die and extrusion residue to the conveying means for conveyance to the second separating means, and for transferring the pressure plate and extrusion residue to the conveying means for conveyance to the first separating means;

second lateral transfer means having a transfer path extending transversely between and interconnecting the conveying path and the press axis adjacent the said other end position, the said second lateral transfer means being arranged and adapted to transfer a pressure plate and extrusion residue from the press axis to the conveying means after direct extrusion and to transfer a die from the conveying means to the press axis prior to indirect extrusion;

means for moving the second lateral transfer means in the longitudinal direction of the press axis and of the conveying path, the second lateral transfer means having respective positions for receiving the pressure plate and direct extrusion residue on the press axis, for transferring the same to the conveying means for conveyance to the first separating means, and for receiving from the conveying means dies conveyed from the second separating means;

and means for returning separated pressure plates from the first separating means to the press axis.

3. The press of claim 2 in which the said second lateral transfer means comprises a lever pivotable transversely to the press axis, and a gripper carried by the said lever which can be opened and closed for gripping the pressure plate or die.

4. The press of claim 2 having a press frame comprising two longitudinal columns, and in which the said second lateral transfer means comprise an angled lever pivotable transversely to the press axis about a pivot axis positioned lower than the press frame, this lever having an outer portion and an inner portion, the outer portion being pivotable to a limited extent in the pivoting plane of the lever relative to the inner portion, the said outer portion extending between the said two columns when the said lever is in its position pivoted towards the press axis.

5. The press of claim 2 in which the said second lateral transfer means has respective defined end positions intersecting the press axis and the conveying path respectively, and a defined intermediate position outside the working region of the conveying means.

6. The press of claim 2 further including separating means ajacent the press axis for separating the die and associated extrusion residue from the pressure plate and associated extrusion residue, after indirect extrusion and prior to transfer thereof by the said first lateral transfer means to the conveying means.

* * * * *